US009848709B2

(12) United States Patent
Molenda

(10) Patent No.: US 9,848,709 B2
(45) Date of Patent: Dec. 26, 2017

(54) MULTI LAYERED MODULAR SUPPORT SYSTEM FOR LOUNGE AND OTHER APPLICATIONS

(71) Applicant: Donald J. Molenda, Oak Harbor, WA (US)

(72) Inventor: Donald J. Molenda, Oak Harbor, WA (US)

( * ) Notice: Subject to any disclaimer, the term of this patent is extended or adjusted under 35 U.S.C. 154(b) by 0 days.

(21) Appl. No.: 14/731,329

(22) Filed: Jun. 4, 2015

(65) Prior Publication Data

US 2016/0353893 A1 Dec. 8, 2016

(51) Int. Cl.

| | |
|---|---|
| ***A47C 7/72*** | (2006.01) |
| ***A47C 1/14*** | (2006.01) |
| ***A47C 23/00*** | (2006.01) |
| ***A47C 7/18*** | (2006.01) |

(52) U.S. Cl.

CPC ..... *A47C 7/72* (2013.01); *A47C 1/143* (2013.01); *A47C 7/185* (2013.01); *A47C 7/725* (2013.01); *A47C 23/002* (2013.01)

(58) Field of Classification Search

None

See application file for complete search history.

(56) References Cited

U.S. PATENT DOCUMENTS 4,192,547 A * 3/1980 Geier ..... A47C 7/02 297/271.5
4,226,506 A * 10/1980 Auger ..... F24J 2/10 359/852
4,367,897 A * 1/1983 Cousins ..... A47C 7/022 297/284.3
4,798,414 A * 1/1989 Hughes ..... A47C 7/462 297/284.4
4,802,521 A * 2/1989 Tsuchida ..... A01G 9/222 160/172 R
5,060,326 A * 10/1991 Oswald ..... A47C 23/002 5/236.1
6,877,816 B1 * 4/2005 Farmont ..... A47C 1/143 297/284.1
7,534,215 B2 * 5/2009 Saringer ..... A47C 3/02 601/103
8,919,057 B1 * 12/2014 Dupray ..... E04B 5/36 52/223.1
9,564,851 B2 * 2/2017 Conger ..... H02S 20/10
2007/0228800 A1 * 10/2007 Tubergen ..... A47C 7/28 297/452.63
2010/0207431 A1 * 8/2010 Petzel ..... B60N 2/4415 297/180.16
2015/0362028 A1 * 12/2015 Sander ..... F16D 65/0976 188/73.38

* cited by examiner

*Primary Examiner* — David E Allred

(57) ABSTRACT

A lounge having a matrix mat and a plurality of modules capable of being inserted into the matrix mat. The lounge may include a frame configured as a rigid frame, a modular frame, and combinations thereof. The modular frame may further include a tri-cable suspension. The tri-cable suspension may be attached to a dilator retractor mechanism. The modules may be a mushroom cap module, a spider spring module, a web module, a lighting module, an electronics module, and combinations thereof.

1 Claim, 12 Drawing Sheets

MULTI LAYERED MODULAR SUPPORT SYSTEM FOR LOUNGE AND OTHER APPLICATIONS

TECHNICAL FIELD

This invention relates to furniture and suspension systems. More specifically, this invention relates to suspension systems that are useful in a variety of applications, and furniture making use of those suspension systems.

BACKGROUND OF THE INVENTION

There have been a number of examples of springs, foams, trusses, cords, shock absorbers, suspensions, and other means for supporting a person or other objects. These have been used in a wide variety of applications, including without limitation, furniture, vehicles, stands, and conveyors. These prior art methods and systems often lack versatility, flexibility, adjustability, adaptability, modularity, and other desirable features. The present invention overcomes those and other drawbacks of the prior art.

SUMMARY OF THE INVENTION

The present invention may include a lounge having a matrix mat and a plurality of modules capable of being inserted into the matrix mat. As used herein, a "lounge" can be any apparatus upon which a person or other object may rest, including without limitation, a lounger, a hammock, a bed, a couch, a chair, a foot stool, a table, a conveyor belt, and a vehicle. Also as used herein, a "matrix mat" is a flexible or rigid material with openings allowing for insertion and removal of modules. As used herein, a module is any apparatus capable of being removably inserted into a matrix mat having an outer surface suitable for contact with a desired use. A module may further include any apparatus capable of being removably inserted into a matrix mat having a function desired by a user. Examples of such functions include, but are not limited to, a cup holder, a cooler, or a storage compartment.

For example, and not meant to be limiting, the outer surface of a module could be a surface suitable for contact with a human being or an animal. As another example, and also not meant to be limiting, the outer surface could be suitable for contact with terrain where the module is used in a transportation application, or with industrial or other goods where the module is used in a manufacturing or material handling application, or in applications where the outer surface is used to move or rotate humans or animals.

The modules may further include an upholstery cover and a foam insert disposed within the interior of the upholstery cover. The modules may be capable of being displaced in more than one direction by an applied force. The lounge may include a frame connected to the matrix mat. The frame may be configured as a rigid frame, a modular frame, and combinations thereof. As used herein a frame is any apparatus that is capable of suspending the matrix mat. Also as used herein, a rigid frame is any apparatus that is capable of suspending the matrix mat the elements of which are fixed and a modular frame is any apparatus that is capable of suspending the matrix mat the elements of which are easily removed and replaced with functional substitutes having differences in color, shape, material, size or texture.

The modular frame may further include a tri-cable suspension. The tri-cable suspension may be attached to a dilator retractor mechanism.

While not meant to be limiting, the modules of the present invention may include a mushroom cap module, a spider spring module, a web module, a lighting module, an electronics module, and combinations thereof.

The modules may include an upholstery collar attached to a module frame, and the module frame may be capable of being inserted into the matrix mat. The modules may further include an upholstery cover removably attached to the module frame and a foam insert disposed within the interior of the upholstery cover. While not meant to be limiting, the upholstery cover may be formed as a single unit with the upholstery collar.

One aspect of the present invention is a mushroom cap module that may be capable of being removably inserted into a matrix mat and may include an upholstery collar attached to a module frame and an upholstery cover. The mushroom cap module may further include a foam insert disposed within the interior of the upholstery cover. The mushroom cap module may further include a control head adjacent to the foam insert. The control head may be supported by a strut quad socket having a top end and a bottom end. The strut quad socket may be attached to the control head at the top end, and to one or more sili tube longs at the bottom end.

As used herein, sili means any flexible material capable of stretching and resisting an external force that retains its original shape when the force is removed. A sili tube is therefore a sili material in the shape of a tube.

The sili tube longs may have a top end and a bottom end, and the sili tube longs may be attached to the strut quad socket at the sili tube long's bottom end, and may further be attached to one or more sili tube shorts at the sili tube long's top end. The sili tube shorts may have an inside end and an outside end, and the sili tube shorts outside end may be attached to the sili tube long's top end, and the sili tube shorts inside end may be attached to a quad pivot.

Sili tubes may be replaced with other sili tubes having greater or lesser resistance. In this manner, the resistance of the mushroom cap module to an external force becomes readily adjustable.

The strut quad socket may pass through the quad pivot in such a manner that the upholstery cover is capable of being displaced in more than one direction by an applied force. As the upholstery cover of the mushroom cap module is displaced by an applied force, the resistance applied by the long and short sili tubes on the strut quad socket may increase in proportion to the magnitude of displacement.

Another aspect of the invention is spider spring module that may be capable of being removably inserted into a matrix mat. The spider spring module may include an upholstery collar attached to a module frame and an upholstery cover. The spider spring module may further include a foam insert disposed within the interior of the upholstery cover. The foam insert may be adjacent to a control head. The control head may be supported by a top spider spring and a bottom spider spring, the top and bottom spider springs may be attached to an o-ring, and the o-ring may further be attached to a plurality of vane spring to o-ring bands. The plurality of vane spring to o-ring bands may be attached to a vane spring. The vane spring may be attached to a spider vane shaft, such that the upholstery cover is capable of being displaced in more than one direction by an applied force and the spider vane shaft slides through an aperture in the bottom spider spring under such an applied force. As the spider spring module is displaced by an applied force, the resistance applied by the spider springs on the control head may be increased in proportion to the magnitude of displacement.

The spider spring, o-rings and vane spring may be replaced with other spider springs, o-rings and vane springs having greater or lesser resistance. In this manner, the resistance of the spider spring module to an external force becomes readily adjustable.

Another aspect of the invention is a web module that may be capable of being removably inserted into a matrix mat. The web module may include an upholstery collar attached to a magazine and an upholstery cover. The web module may also include a foam insert disposed within the interior of the upholstery cover. The foam insert may be adjacent to a control head, and the control head may be supported by the top end of a center shaft. The center shaft may be disposed through a plurality of web springs attached to the magazine, and the bottom end of the center shaft may be free floating in such a manner that the upholstery cover is capable of being displaced in more than one direction by an applied force. The web module may be capable of being displaced in more than one direction by an applied force in such a manner that when the upholstery cover is displaced the resistance applied by the web springs on the center shaft is increased in proportion to the magnitude of displacement. The magazine may be a single magazine, or it may be formed of a first magazine and a second magazine.

The web springs may be replaced with other web springs having greater or lesser resistance. In this manner, the resistance of the web module to an external force becomes readily adjustable.

As described above, the web springs, spider spring, o-rings, vane spring, sili tubes, and other components of the present invention may be designed to be modular such that they can readily be replaced with replacement parts. The replacement parts may be selected as having differences in durometer, shore, elasticity and other properties. In this manner, the suspension provided by the various components of the present invention can be adjusted as desired by a user. For example, and not meant to be limiting, by selecting different parts with different hardness, elasticity or resilience, the suspension of the various assemblies may be made to be more or less firm, bouncy, or dampening.

Another aspect of the invention is a lighting module that may be capable of being removably inserted into a matrix mat. The lighting module may include an upholstery collar attached to a lighting base and an upholstery cover. A foam insert may be disposed within the interior of the upholstery cover, and the foam insert may be adjacent to a control head. A threaded support shaft may be disposed through an aperture in the control head, upholstery cover, and foam insert. The threaded support shaft may include a light source at one end. While not meant to be limiting, the light source may be a light emitting diode, or LED, which in turn may be powered by electrical power from a conventional wall socket or from a battery. The battery may be rechargeable. The light source may further be attached to a light conduit. The light conduit may have a light housing attached thereto, such that light from the light source may traverse through the threaded support shaft, through the light conduit, and out of the light housing.

Another aspect of the invention is a U-Bow suspension. The U-Bow suspension may include a U-Bow frame having a top surface flexibly affixed to two inwardly curved side surfaces at each top end, wherein the curved side surfaces join at the bottom end. The U-Bow suspension may further include a U-Bow Omega Support placed in the interior of the U-Bow frame, wherein the U-Bow Omega Support has a top surface flexibly affixed to two outwardly curved side surfaces at the top end, and wherein the curved side surfaces join at the bottom end of the U-Bow Omega Support. The top surface of the U-Bow Omega Support may be in contact with the top surface of the U-Bow frame and the inwardly curved side surfaces of the U-Bow frame may be in contact with the outwardly curved side surfaces of the U-Bow Omega Support. Alternatively, the U-Bow suspension may be a U-Bow frame and a U-Bow Omega Support formed as a single piece. In either configuration, the U-Bow suspension may support a load in such a manner that when an increase in load is applied to the top surface of the U-Bow frame, the U-Bow suspension apparatus becomes progressively more rigid in response.

The U-Bow suspension apparatus may further include cable guides affixed to at least one of the U-Bow Omega Support or the U-Bow frame. The U-Bow suspension apparatus may be configured where two of the cable guides are outer cable guides affixed to the inwardly curved side surfaces of the U-Bow frame and another cable guide is a lower cable guide affixed to the outwardly curved side surfaces of the U-Bow Omega Support.

Another aspect of the invention is a tri-cable suspension comprising three cables that may be attached at one end to a tricable spreader, and may further be attached at the other end to a dilator retractor assembly. The tri-cable suspension may also include at least one compression tube surrounding at least one of the cables. The tri-cable suspension may further include a suspension apparatus affixed to the cables. The tri-cable suspension may be configured such that the suspension apparatus affixed to the cables is a U-Bow suspension apparatus.

The tri-cable suspension may include a dilator retractor assembly. The dilator retractor assembly may include a first V-Plate retractor disc adjacent to a first dilator disc and a second V-Plate retractor disc adjacent to a second dilator disc. The V-Plate refractor discs, dilator discs and cables may be arranged such that the rotation of one or both of the dilator discs and the V-Plate retractor discs provides movement of the cables toward and away from a center line.

The tri-cable suspension may further include a motor to drive rotation of one or both of the dilator discs and the V-Plate retractor discs. The tri-cable may further include a threaded shaft such that when the threaded shaft is rotated, the first V-Plate retractor disc and first dilator disc are displaced from the second V-Plate retractor disc and second dilator disc along the center line, thereby tightening or loosening the cables.

Another aspect of the present invention is the combination of the forgoing assemblies into a lounge having a matrix mat and a plurality of modules capable of being inserted into the matrix mat, a modular frame having a tri-cable suspension, the tri-cable suspension attached to a dilator retractor mechanism and to one or more U-Bow suspension apparatuses, and wherein the U-Bow suspension apparatus provides support to the matrix mat.

Another aspect of the invention is electronics components that may be incorporated into the matrix mat, the modules, and the other parts of the assembly. For example, and not meant to be limiting, the modules may be equipped with sensors that allow a computer to record the position of the modules when a lounge is used by a user. In this manner, the optimum configuration of the overall system may be tracked and adjusted. This functionality also allows the system and the system components to be remotely adjusted.

Other functional assemblies may also be incorporated into the matrix mat, the modules, and the other parts of the invention. For example, and not meant to be limiting, electronic components that provide therapeutic treatments, such as vibration and heat, may be incorporated into some or all of the modules, the matrix mat, the frame, the tri-cable suspension, or the other components, to provide those therapeutic benefits to a user.

BRIEF DESCRIPTION OF THE DRAWINGS

The following detailed description of the embodiments of the invention will be more readily understood when taken in conjunction with the following drawings, wherein.

DETAILED DESCRIPTION OF THE PREFERRED EMBODIMENTS

Figure 1:
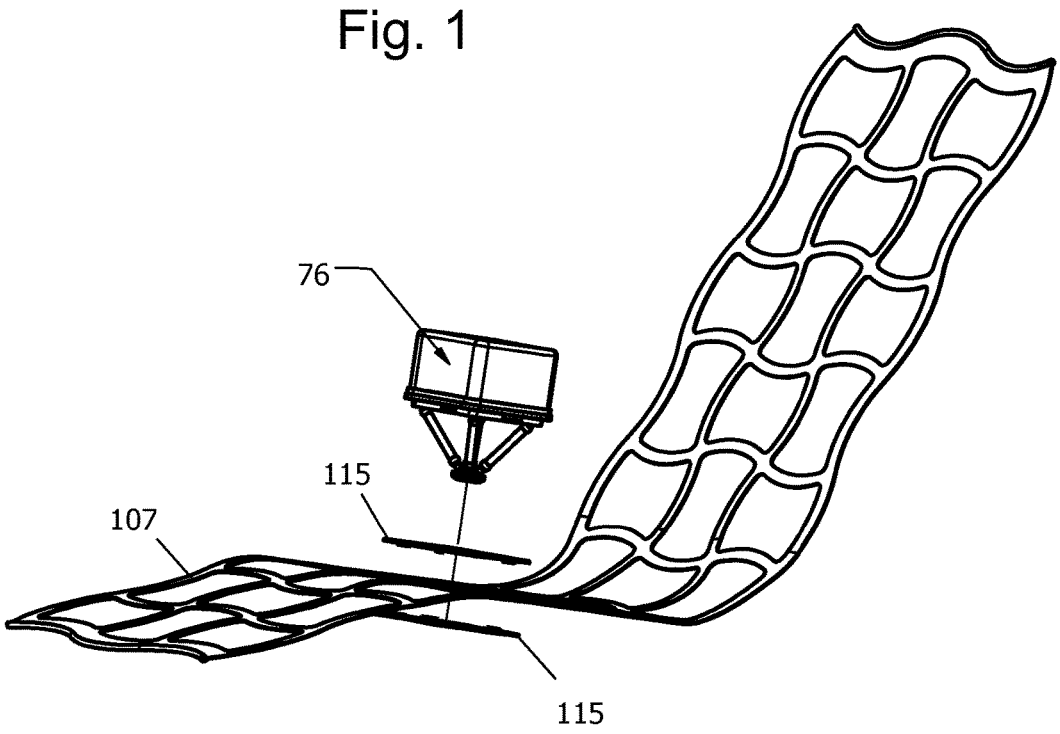
FIG. 1 is an illustration of one embodiment of the apparatus of the present invention showing a matrix mat and an exemplary module.

For the purposes of promoting an understanding of the principles of the invention, reference will now be made to the embodiments illustrated in the drawings and specific language will be used to describe the same. It will nevertheless be understood that no limitations of the inventive scope is thereby intended, as the scope of this invention should be evaluated with reference to the claims appended hereto. Alterations and further modifications in the illustrated devices, and such further applications of the principles of the invention as illustrated herein are contemplated as would normally occur to one skilled in the art to which the invention relates.

FIG. 1 is an illustration of one embodiment of the apparatus of the present invention showing a matrix mat 107 and an exemplary module 76. Also shown is an exemplary docking collar 115.

Figure 2:
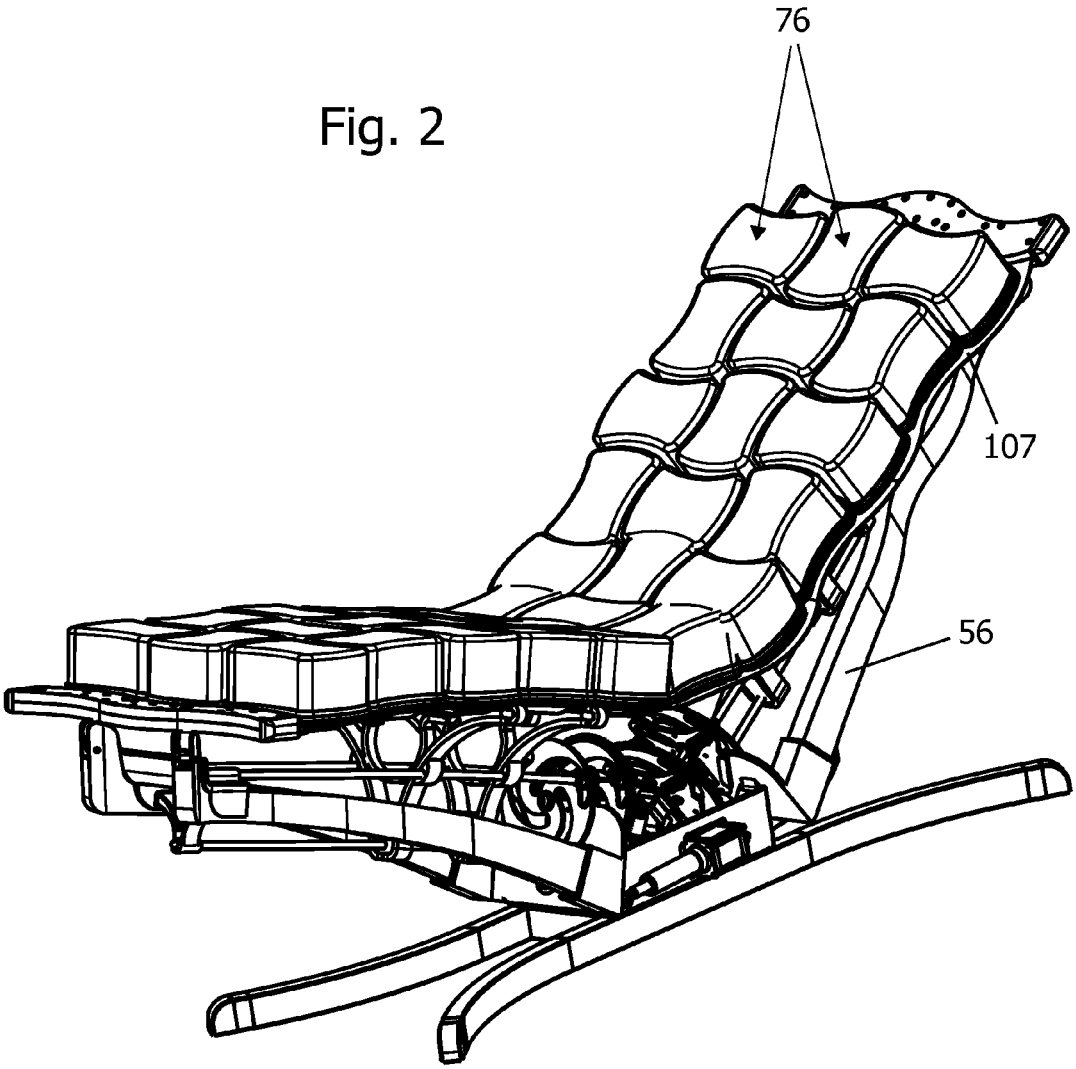
FIG. 2 is an illustration of one embodiment of the apparatus of the present invention showing an exemplary matrix mat, modules, frame, and tri cable suspension system.

FIG. 2 is an illustration of one embodiment of the apparatus of the present invention showing an exemplary matrix mat 107, modules 76, modular frame 56, and tri cable suspension system 54 and dilator retractor 55. As shown in FIG. 2, the modules 76 each have a top and bottom side and a left and right side and the top and bottom sides are generally outwardly curved and the left and right sides are generally inwardly curved. While not meant to be limiting, the modules 76 may be of any shape, however the arrangement wherein the top and bottom sides are generally outwardly curved and the left and right sides are generally inwardly curved is preferred as it provides specific functional advantages over certain alternative arrangements. Specifically, having the modules 76 shaped in a manner wherein the top and bottom sides are generally outwardly curved and the left and right sides are generally inwardly curved allows the arrangement of the modules 76 on the matrix mat 107 in a more ergonomically advantageous geometry than other alternatives. Further, this arrangement is less prone to pinching or poking a user at the intersection of adjacent modules 76.

Figure 3:
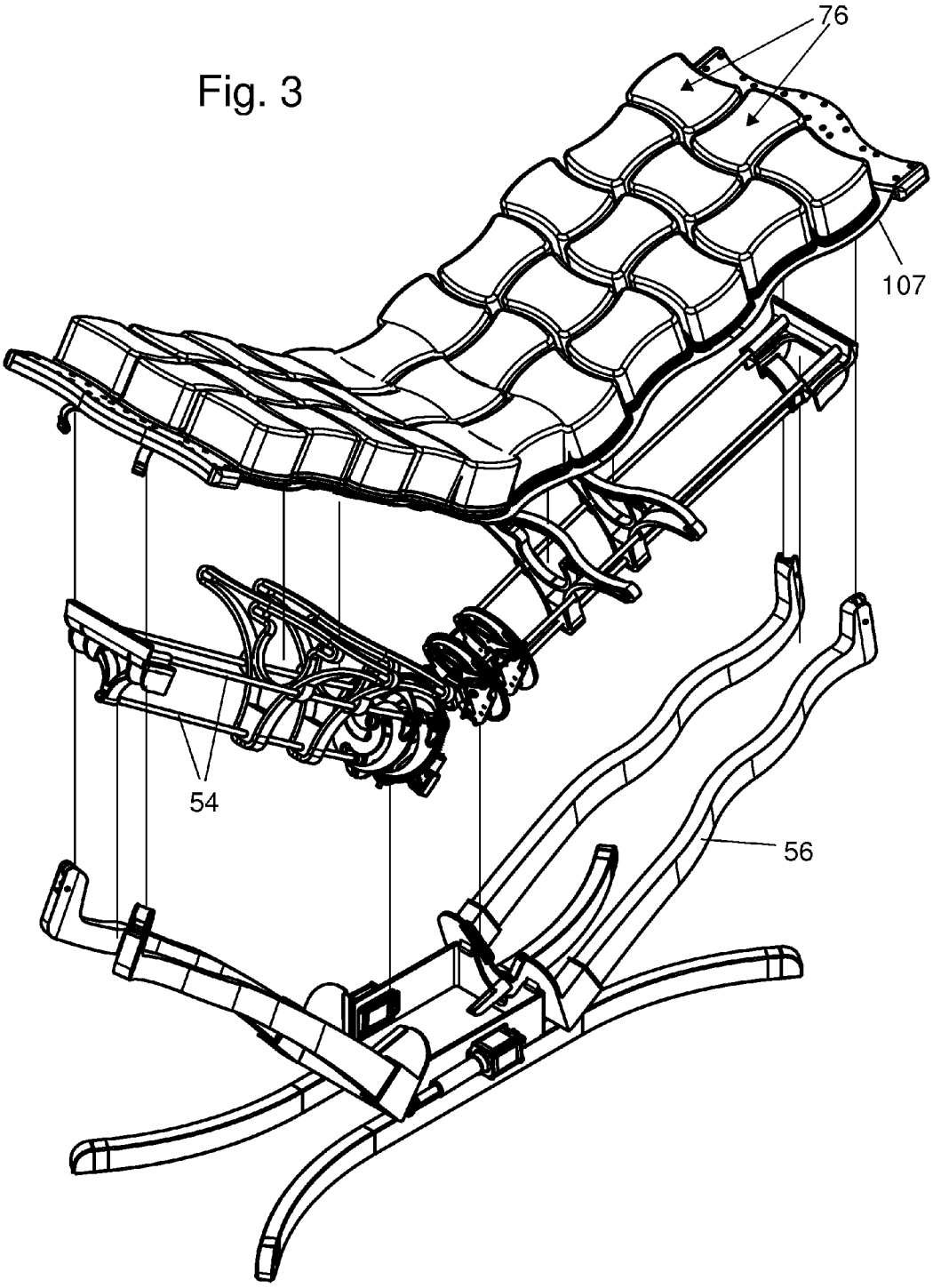
FIG. 3 is an illustration of one embodiment of the apparatus of the present invention showing an exploded view of FIG. 2.

FIG. 3 is an illustration of one embodiment of the apparatus of the present invention showing an exploded view of FIG. 3

Figure 4:
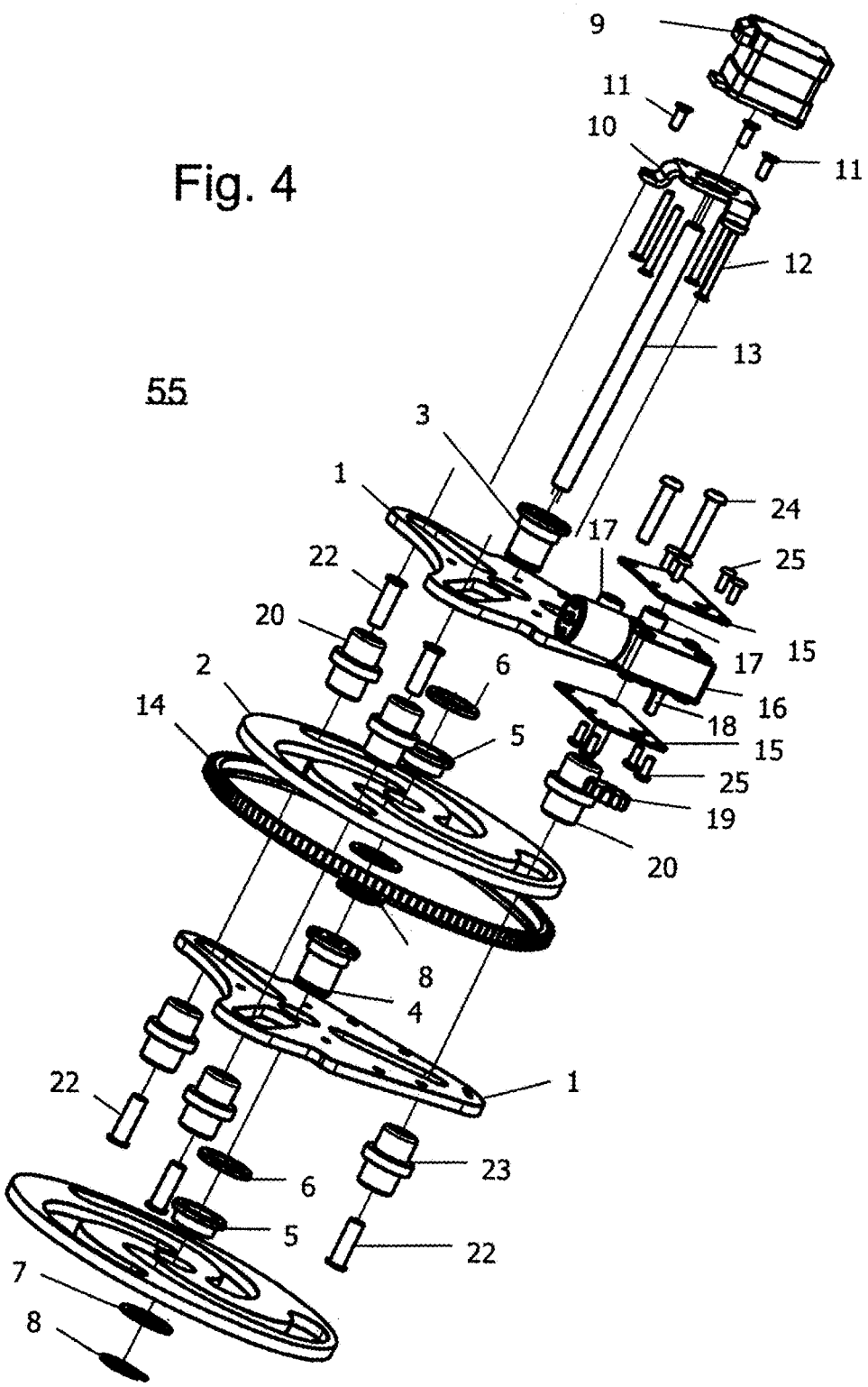
FIG. 4 is an illustration of one embodiment of the apparatus of the present invention showing a detailed exploded view of a exemplary dilator retractor.

FIG. 4 is an illustration of one embodiment of the apparatus of the present invention showing a detailed exploded view of a exemplary dilator retractor 55. As shown in FIG. 4, the dilator refractor includes a first V-Plate retractor disc 1 adjacent to a first dilator disc 2 and a second V-Plate retractor disc 1*a* adjacent to a second dilator disc 2*a* wherein a threaded shaft 13 is provided such that when the threaded shaft 13 is rotated, the first V-Plate retractor disc 1 and first dilator disc 2 are displaced from the second V-Plate retractor disc 1*a* and second dilator disc 2*a* along the center line, thereby tightening or loosening the cables (not shown) that pass through dilator disc cable guides 23. The threaded shaft 13 passes through two V Plate Refractor Disc Bushings 3 and 4, a Dilator Disc Bushing 5, and a Dilator Disc to V Plate Retractor Spacer 6. The assembly is held together with a retainer clip 8 adjacent to a retainer clip washer 7. Dilator Disc 2 is connected to Dilator Disc Ring Gear 14. Screws 11 and bolts 12 hold V Plate Retractor Disc Motor 9 on V Plate Retractor Disc Motor Mount 10. Screws 24 and 25 hold Dilator Disc Motor Bracket 15 to Dilator Disc Motor 16 in combination with Dilator Disc Motor Mounting Bracket Spacer 17. Dilator Disc Motor 16 drives Dilator Disc Shaft 18 which in turn drives Dilator Disc Motor Pinion Gear 19. Dilator Disc Motor Pinion Gear in turn drives Dilator Disc Ring Gear 14 which drives Dilator Disc 2. As Dilator Disc 2 is rotated, Dilator Disc Cable Guide Inboard Plate 20 and Dilator Disc Cable Guide Outboard Plate 23 move along grooves in V Plate Retractor Disc 1 causing Cable Guide Bushing Insert 22 to move cables (not shown) toward or away from the center line of the dilator retractor 55.

Figure 5:
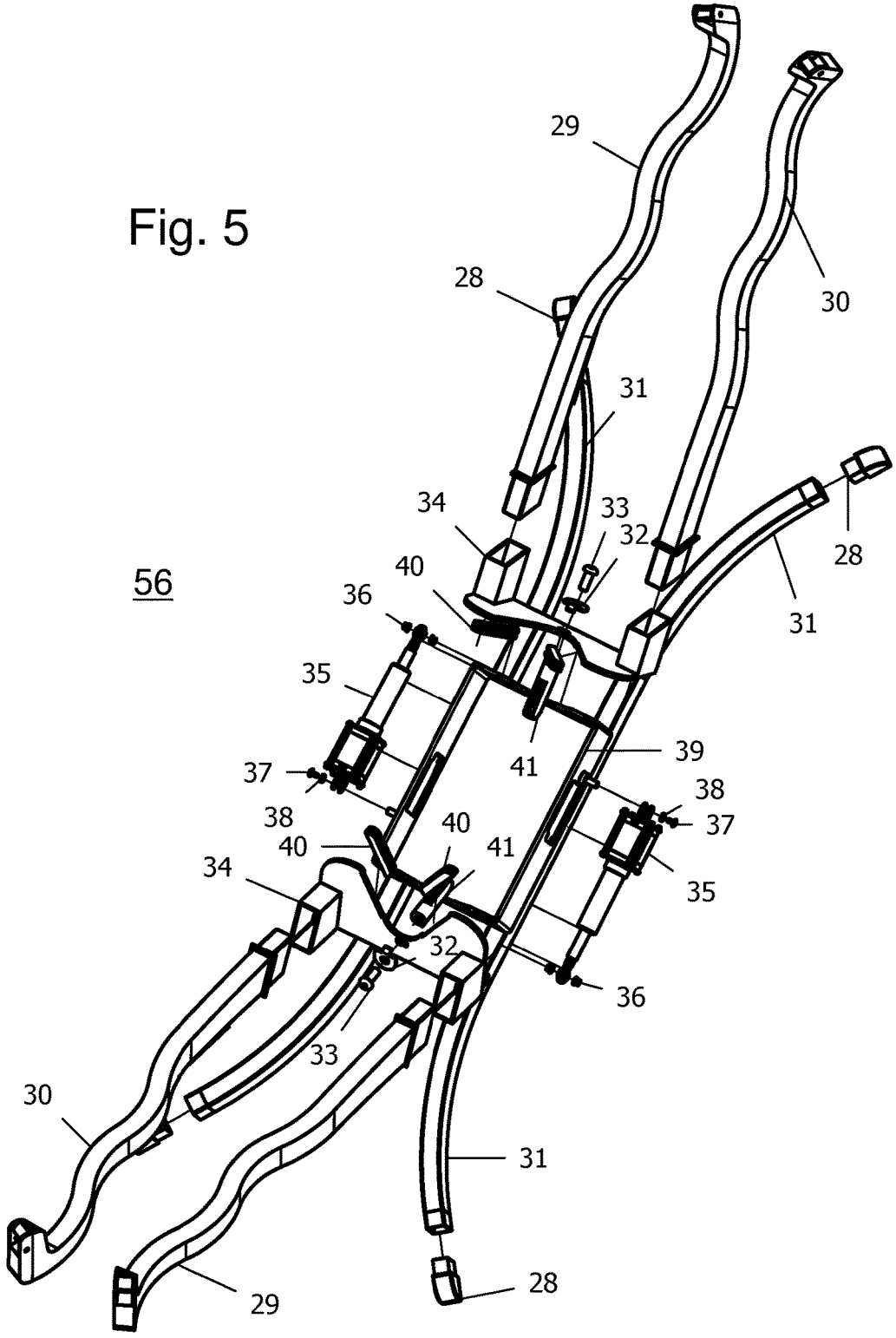
FIG. 5 is an illustration of one embodiment of the apparatus of the present invention showing a detailed view of an exemplary modular frame.

FIG. 5 is an illustration of one embodiment of the apparatus of the present invention showing a detailed view of an exemplary modular frame 56. As shown in FIG. 5, modular frame 56 includes a Base Leg End Insert 28 attached to Base Leg 31. Modular Left Arm 29 and Modular Right Arm 30 are attached to modular frame 56 by insertion into Modular Base Receiver 34. Modular Base Receiver 34 is attached to Modular Base Housing 39 by integral hinges protruding from Modular Base Receiver 34 inserted into Modular Base Housing slots. V Plate 1 shown in FIG. 4 is held down by V plate Hold Down Clip 32 attached with a head cap screw 33 inserted through V Plate Hold Down Clip 32 and Modular Base Receiver 34 respectively, then into V Plate Support Guide 41. Linear Actuator 35 adjusts the distance between each side of the modular frame 56 and is attached to modular frame 56 by Linear Actuator Heim Bushing 36, screw 37 and nylon washer 38.

Figure 6:
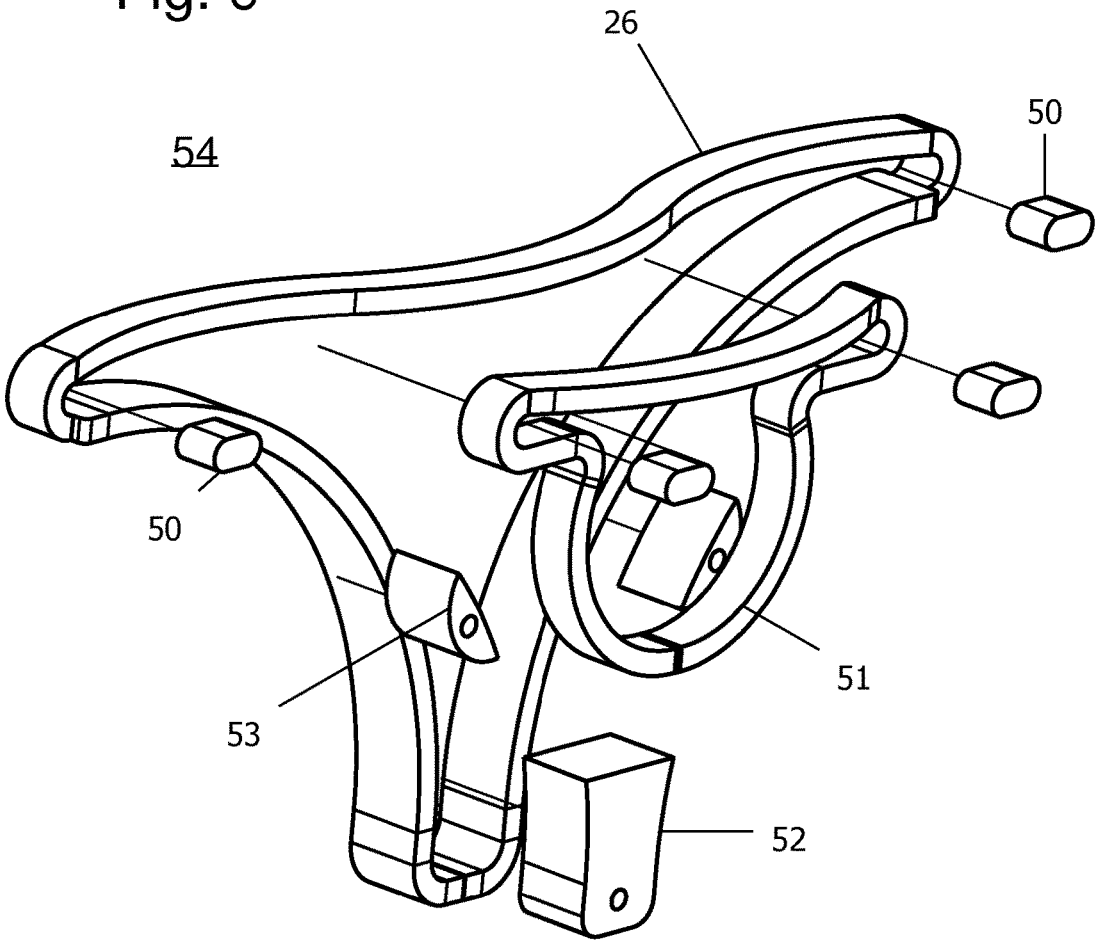
FIG. 6 is an illustration of one embodiment of the apparatus of the present invention showing a detailed exploded view of an exemplary U Bow Cable Guide Support.

FIG. 6 is an illustration of one embodiment of the apparatus of the present invention showing a detailed, exploded view of an exemplary U Bow Cable Guide and Support 54. U Bow Cable Guide and Support 54 is made up of U Bow frame 26, U Bow Upper Wedge 50, U Bow Omega Support 51, U Bow Lower Wedge Cable Guide 52, and U Bow Outer Cable Guides 53.

Figure 7:
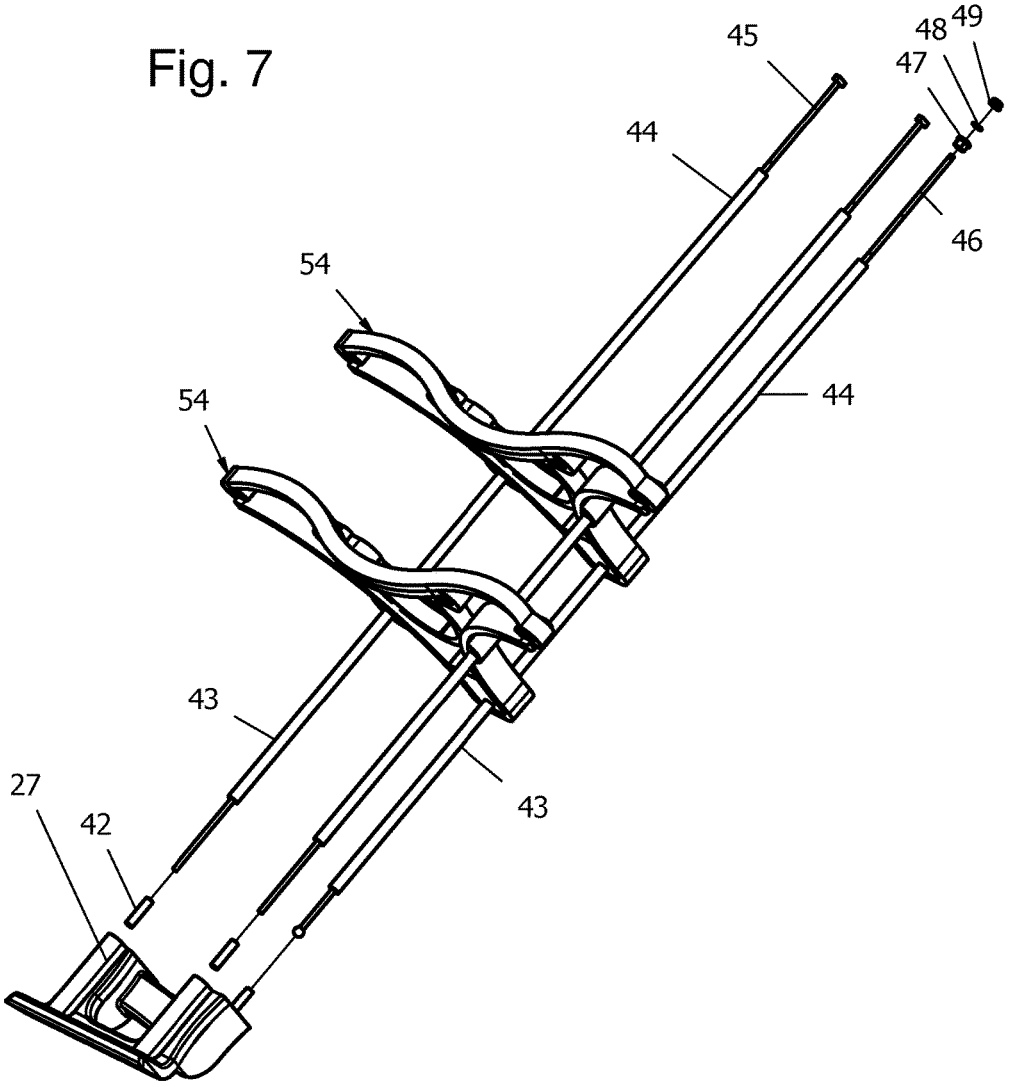
FIG. 7 is an illustration of one embodiment of the apparatus of the present invention showing a detailed view of how an exemplary U Bow Cable Guide and Support may be integrated with an exemplary Tri Cable System.

FIG. 7 is an illustration of one embodiment of the apparatus of the present invention showing a detailed and view of how an exemplary U Bow Cable Guide and Support may be integrated with an exemplary Tri Cable System 75. As shown in FIG. 7, Tri Cable Spreader 27 receives Upper Cables 45 and Lower Cable 46 through nylon bushing 42. Upper Cables 45 and Lower Cable 46 traverse through Upper Compression Tubes 43 and Lower Compression Tubes 44. As tension is brought on Upper Cables 45 and Lower Cable 46, Upper Compression Tubes 43 and Lower Compression Tubes 44 act to increase the stiffness of Upper Cables 45 and Lower Cable 46. Upper Cables 45 and Lower Cable 46 are attached to V-Plate retractor disc 1 shown in FIG. 4 with Cable Adjustor Bushing 47, Cable Adjustor Nut 48 and a hex flange nut 49. Upper Cables 45 and Lower Cable 46 then hold U Bow Cable Guide and Support 54 as shown in FIG. 6.

Figure 8:
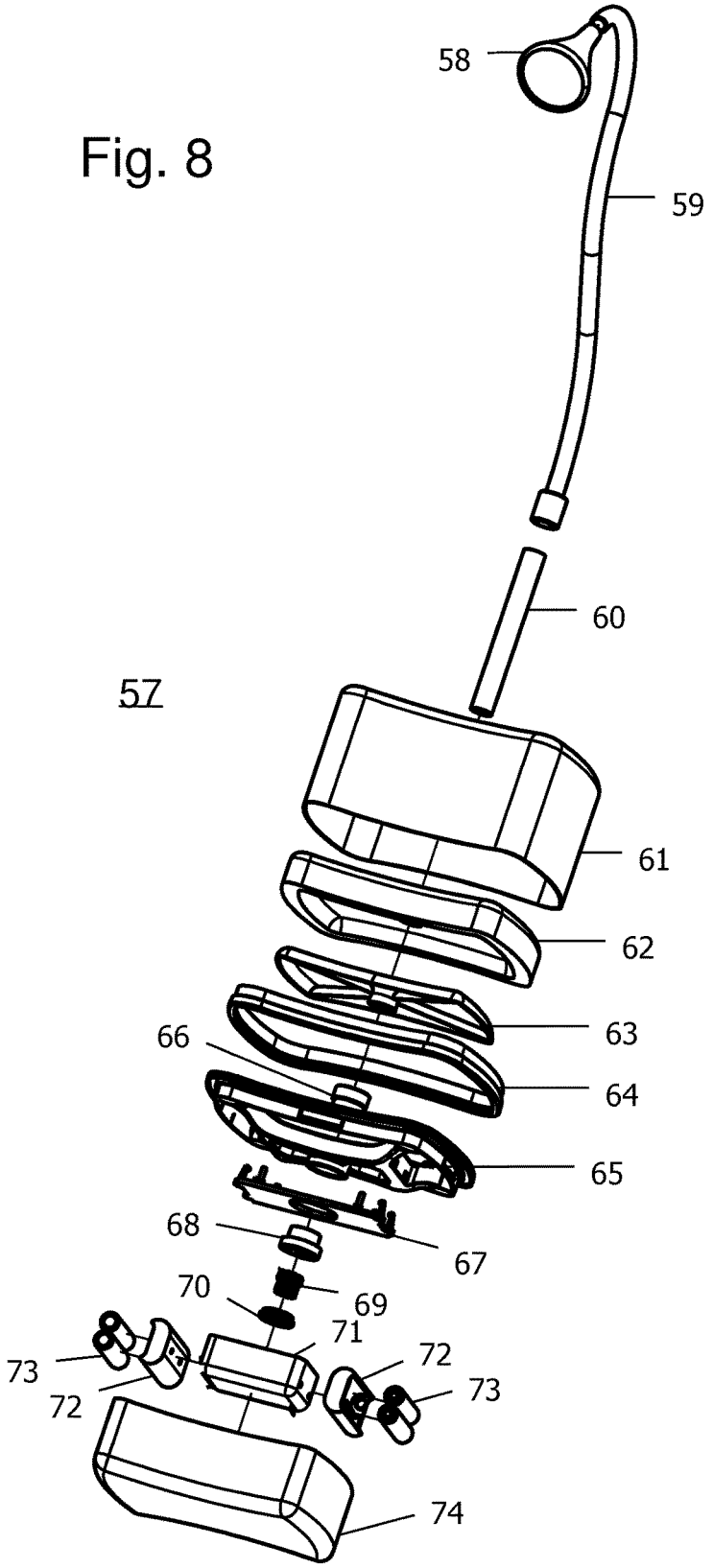
FIG. 8 is an illustration of one embodiment of a lighting module of the present invention showing a detailed exploded view of an exemplary lighting module.

FIG. 8 is an illustration of one embodiment of the lighting module of the present invention showing a detailed exploded view of an exemplary lighting module. As shown in FIG. 8, a light housing 58 is attached to a flexible conduit 59, which is in turn attached to a Threaded Support Shaft 60. Threaded Support Shaft 60 extends through Upholstery Cover 61, Foam Insert 62, Control Head 63, Upholstery Collar 64, and into Support Shaft Receiver 66. Support Shaft Receiver 66 is attached to Light Base 65, which is attached to Control Box Platform 67. LED Holder 68 then holds the LED bulb 69 which is also connected to LED Retainer Plate 70 and contained within Control Box Cover 71. Batteries 73 are used to power LED bulb 69, which are held in place by Battery Snap Case 72. Lower Cover 74 then attaches to Light Base 65, and contains the LED and power components.

Figure 9:
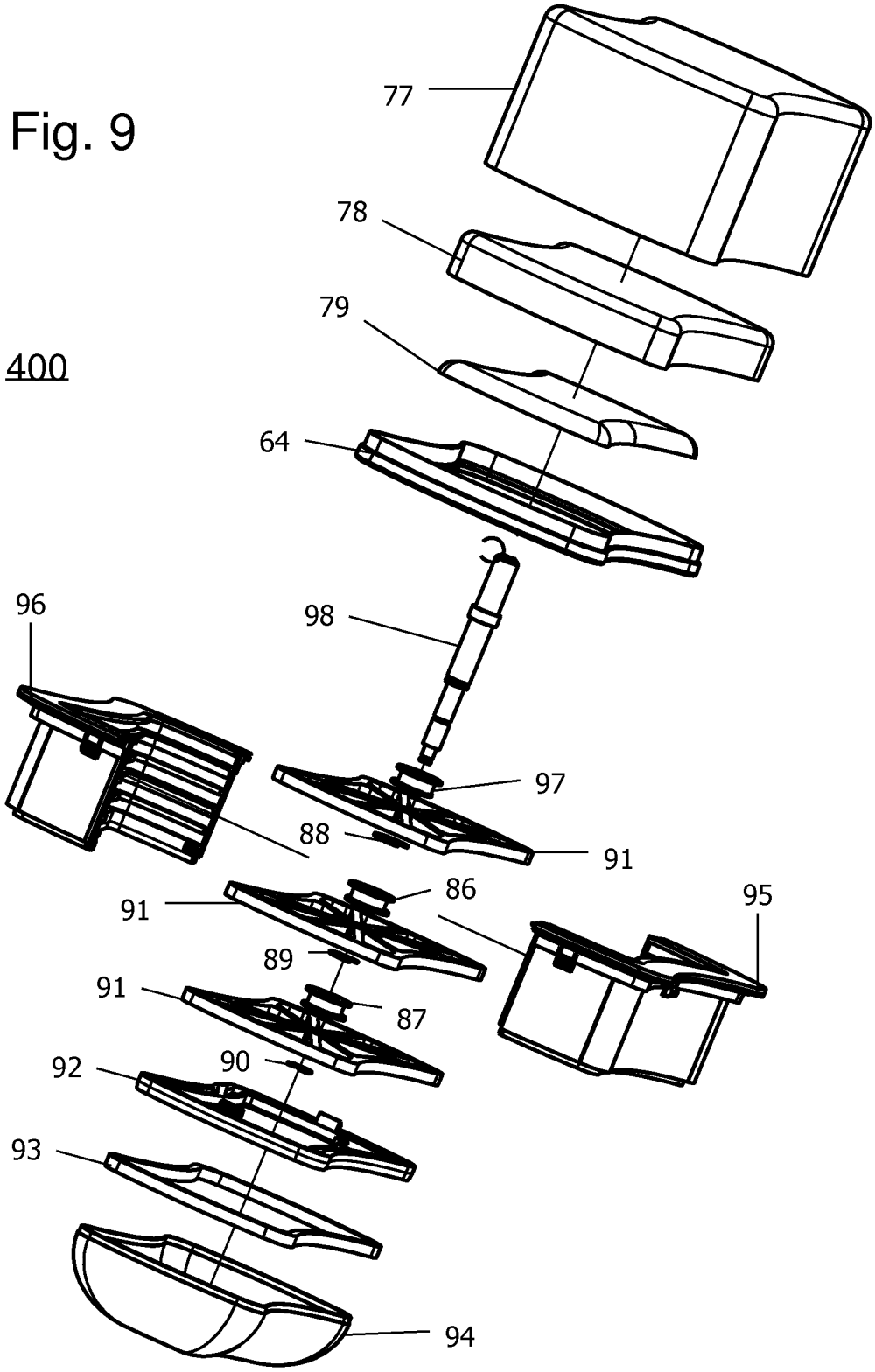
FIG. 9 is an illustration of one embodiment of a Web Module of the present invention showing a detailed exploded view of an exemplary Web Module.

FIG. 9 is an illustration of one embodiment of a Web Module of the present invention showing a detailed exploded view of an exemplary Web Module 400. As shown in FIG. 9, the Web Module 400 may include an Upholstery Collar 64 attached to a Magazine, which may be in two parts 95 and 96, an Upholstery Cover 77, a foam insert 78 disposed within the interior of the upholstery cover 77. The foam insert 78 may be adjacent to a Control Head 79, and the Control Head may be supported by the top end of a Center Shaft 98. As shown in FIG. 9, the Center Shaft 98 is disposed through a plurality of Web Springs 91 attached to the Magazine 95 and 96, in such a manner that the bottom end of the Center Shaft 98 is free floating. Center Shaft 98 extends through Web Centers, 86, 87 and 97, which connect Center Shaft 98 to Web Springs 91, and are held in place by Clips 88, 89 and 90. Bottom Cover Lock Flange 92 and Bottom Cover Ring 93 then hold Bottom Cover Ring Screen 94 to Magazine, which may be in a single piece (not shown), or in two parts 95 and 96, as shown.

Figure 10:
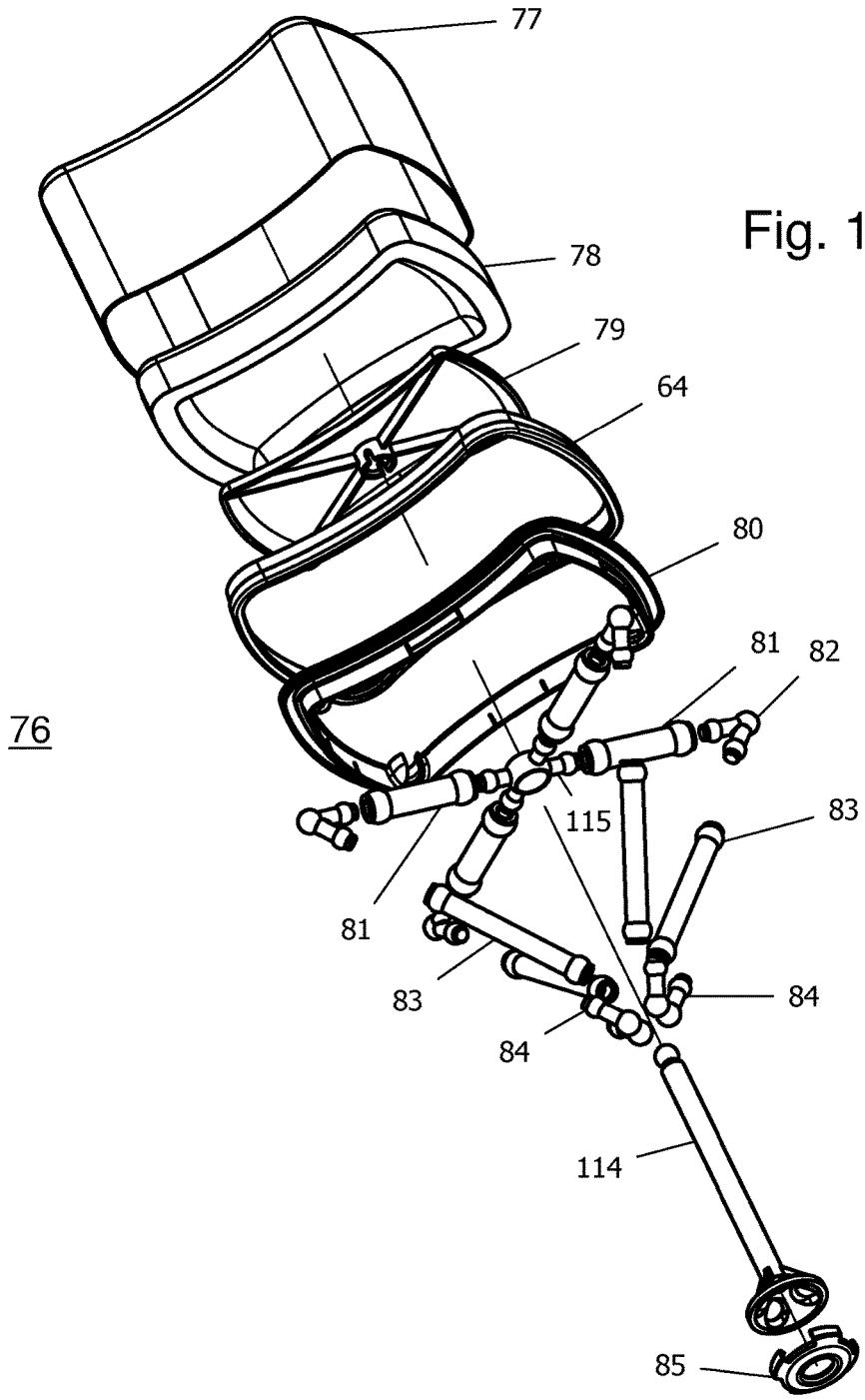
FIG. 10 is an illustration of one embodiment of a Mushroom Cap Module of the present invention showing a detailed view of an exemplary Mushroom Cap Module.

FIG. 10 is an illustration of one embodiment of a Mushroom Cap Module of the present invention showing a detailed and exploded view of an exemplary Mushroom Cap Module 76. As shown in FIG. 10, the mushroom cap module 76 is capable of being removably inserted into a matrix mat 107 and includes an upholstery collar 64 attached to a module frame 80 and an upholstery cover 77. The mushroom cap module 76 further includes a foam insert 78 disposed within the interior of the upholstery cover 77. The mushroom cap module 76 further includes a control head 79 adjacent to the foam insert 78. The control head 79 is supported by a strut quad socket 114 having a top end and a bottom end. The strut quad socket 114 is attached to the control head 79 at the top end and to one or more sili tube longs 83 at the bottom end by single pivot points 84 and a strut cap 85. As will be recognized by those having skill in the art, the strut quad socket 114 may be attached to the sili tube longs 83 using a variety of mechanisms, single pivot points 84 are merely one example. As shown in FIG. 10, the sili tube longs 83 have a top end and a bottom end, and the sili tube longs 83 are attached to the strut quad socket 114 at the sili tube long's 83 bottom end, and are further attached to one or more sili tube shorts 81 at the sili tube long's 83 top end using a double pivot point 82. As was the case with the single pivot points 84, those having skill in the art will recognize that the sili tube shorts 81 may be attached to the sili tube long's 83 using a variety of mechanisms, double pivot points 82 are merely one example. The sili tube shorts 81 have an inside end and an outside end, and the sili tube shorts 81 outside end is attached to the sili tube long's 83 top end, and the sili tube shorts 81 inside end is attached to a quad pivot 115. The strut quad socket 114 passes through the quad pivot 115 in such a manner that as the upholstery cover 77 is displaced by an applied force, the resistance applied by the sili tube longs 83 and sili tube shorts 81 on the strut quad socket 114 will increase in proportion to the magnitude of displacement.

Figure 11:
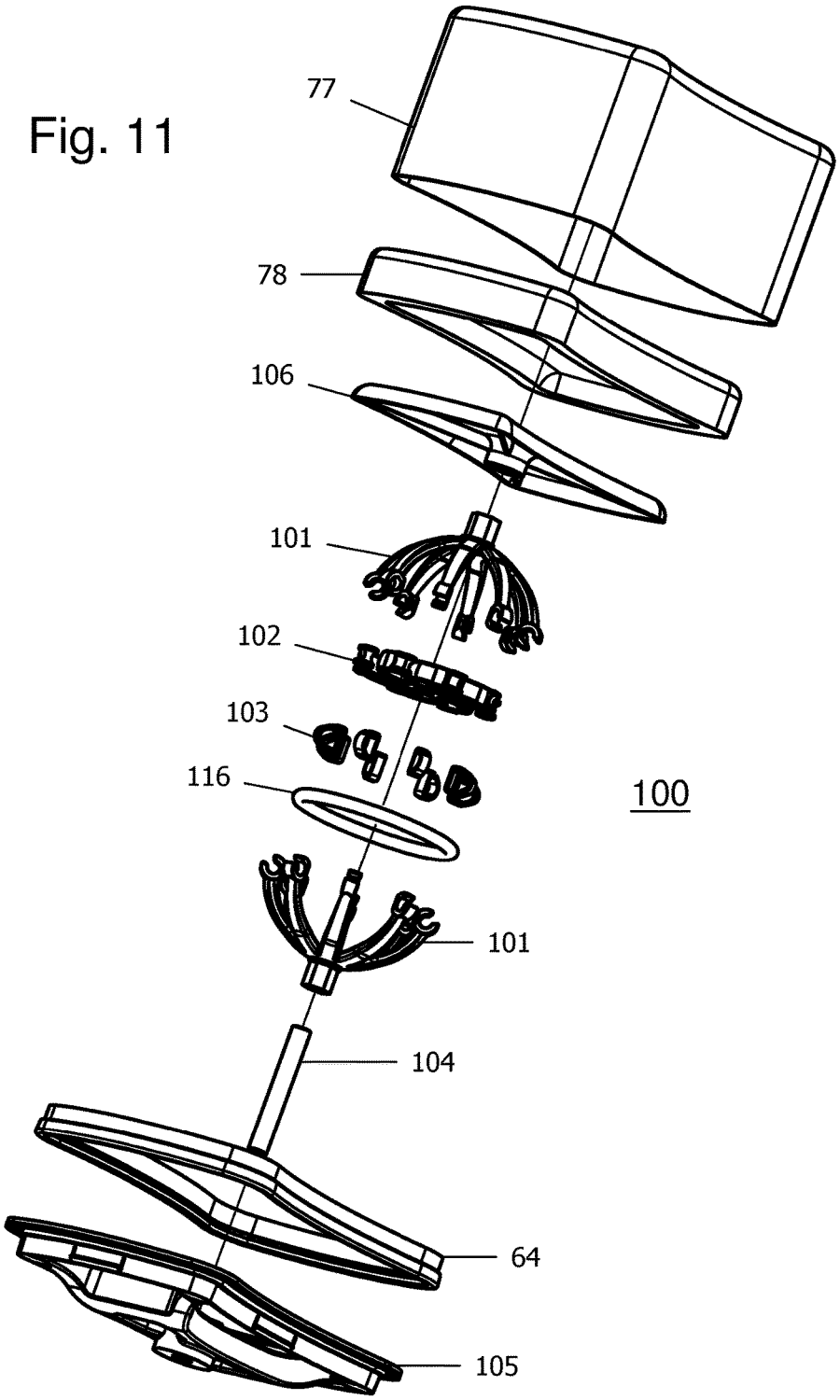
FIG. 11 is an illustration of one embodiment of a Spider Spring Module of the present invention showing a detailed exploded view of an exemplary Spider Spring Module.

FIG. 11 is an illustration of one embodiment of a Spider Spring Module 100 of the present invention showing a detailed exploded view of an exemplary Spider Spring Module 100. As shown in FIG. 11, the spider spring module 100 is capable of being removably inserted into a matrix mat 107 and includes an upholstery collar 64 attached to a module frame 105 and an upholstery cover 77. The spider spring module 100 has a foam insert 78 disposed within the interior of the upholstery cover 77. The foam insert 78 is adjacent to a control head 106. The control head 106 is supported by a top spider spring 101 and a bottom spider spring 101, the top and bottom spider springs 101 are attached to an o-ring 116, and the o-ring 116 is further be attached to a plurality of vane spring to o-ring bands 103. The plurality of vane spring to o-ring bands 103 are attached to a vane spring 102. The vane spring 102 is attached to a spider vane shaft 104, such that when the upholstery cover 77 is displaced by an applied force the spider vane shaft 104 slides through an aperture in the bottom spider spring 101 and the resistance applied by the spider springs 101 on the control head 106 is increased in proportion to the magnitude of displacement.

Figure 12:
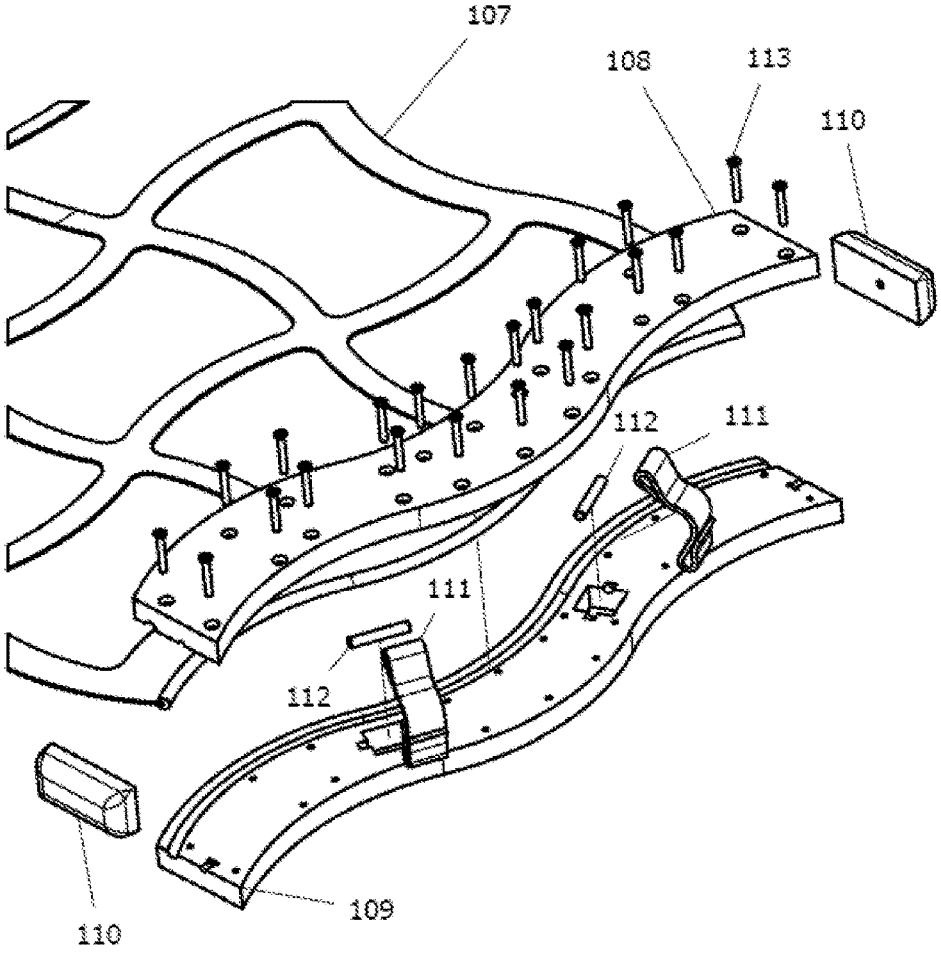
FIG. 12 is an illustration of one embodiment of a Yoke of the present invention showing a detailed view of an exemplary Yoke.

FIG. 12 is an illustration of one embodiment of a Yoke of the present invention showing a detailed view of an exemplary Yoke. As shown in FIG. 12, the matrix mat 107 is attached to a yoke top 108 and a yoke bottom 109 by flat head screws 113. Yoke straps 111 are held in a recess in yoke bottom 109 by a pin 112. Yoke straps 111 may be used to hold matrix mat 107 to the modular frame as shown in FIG. 2. Yoke top 108 and a yoke bottom 109 are further attached to yoke end caps 110.

While the invention has been illustrated and described in detail in the drawings and foregoing description, the same is to be considered as illustrative and not restrictive in character. Only certain embodiments have been shown and described, and all changes, equivalents, and modifications that come within the spirit of the invention described herein are desired to be protected. Any specific examples provided herein are intended to be illustrative of the present invention and should not be considered limiting or restrictive with regard to the invention scope. Further, any theory, mechanism of operation, proof, or finding stated herein is meant to further enhance understanding of the present invention and is not intended to limit the present invention in any way to such theory, mechanism of operation, proof, or finding.

Thus, the specifics of this description and the attached drawings should not be interpreted to limit the scope of this invention to the specifics thereof. Rather, the scope of this invention should be evaluated with reference to the claims appended hereto. In reading the claims it is intended that when words such as "a", "an", "at least one", and "at least a portion" are used there is no intention to limit the claims to only one item unless specifically stated to the contrary in the claims. Further, when the language "at least a portion" and/or "a portion" is used, the claims may include a portion and/or the entire items unless specifically stated to the contrary.

I claim:

1. A lounge comprising:

a matrix mat and a plurality of modules capable of being inserted into the matrix mat, wherein the matrix mat and the plurality of modules form a lounge surface for supporting a person, a modular frame having a tri-cable suspension, said tri-cable suspension attached to a dilator retractor mechanism and to one or more U-Bow suspension apparatuses, the one or more U-Bow suspension apparatus providing support to the matrix mat, wherein adjustment of the dilator retractor causes:

tightening of cables of the tri-cable suspension, which more firmly presses the one or more U-Bow suspension apparatus against an underside of the matrix mat to provide a firm supporting surface atop the matrix mat, or loosening of the cables of the tri-cable suspension, which more loosely supports the one or more U-Bow suspension apparatus against an underside of the matrix mat to provide a soft supporting surface atop the matrix mat.

* * * * *